US011688381B2

(12) United States Patent
Ma et al.

(10) Patent No.: US 11,688,381 B2
(45) Date of Patent: Jun. 27, 2023

(54) FEEDBACK ACTIVE NOISE CONTROL SYSTEM AND STRATEGY WITH ONLINE SECONDARY-PATH MODELING

(71) Applicant: Jiangnan University, Wuxi (CN)

(72) Inventors: Yaping Ma, Wuxi (CN); Yegui Xiao, Wuxi (CN); Dinghui Wu, Wuxi (CN); Linbo Xie, Wuxi (CN); Xin Wang, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 0 days.

(21) Appl. No.: 17/978,354

(22) Filed: Nov. 1, 2022

(65) Prior Publication Data

US 2023/0077396 A1 Mar. 16, 2023

Related U.S. Application Data

(63) Continuation of application No. PCT/CN2021/130193, filed on Nov. 12, 2021.

(30) Foreign Application Priority Data

Sep. 15, 2021 (CN) ..... 202111096212.0

(51) Int. Cl.
*G10K 11/178* (2006.01)

(52) U.S. Cl.
CPC .. *G10K 11/17817* (2018.01); *G10K 11/17853* (2018.01); *G10K 11/17879* (2018.01);
(Continued)

(58) Field of Classification Search
CPC ..... G10K 11/17817; G10K 11/17853; G10K 11/17879; G10K 2210/3012;
(Continued)

(56) References Cited

U.S. PATENT DOCUMENTS 5,559,839 A * 9/1996 Doelman ..... G10K 11/17854 375/233
5,940,519 A * 8/1999 Kuo ..... G10K 11/17817 381/71.8

(Continued)

FOREIGN PATENT DOCUMENTS

CN 105489225 A 4/2016
CN 109448686 A 3/2019

(Continued)

*Primary Examiner* — Vivian C Chin
*Assistant Examiner* — Douglas J Suthers
(74) *Attorney, Agent, or Firm* — IPro, PLLC

(57) ABSTRACT

The present disclosure presents a feedback active noise control system and strategy with online secondary-path modeling, and belongs to the technical field of active noise control. The linear prediction subsystem takes the residual noise as its input and separates the remaining sinusoidal noise from the broadband noise. The remaining sinusoidal noise is used effectively not only to update the controller but also to scale the auxiliary noise, while the broadband noise serves as a desired input of online secondary-path modeling subsystem. In this way, the coupling between the controller and the online secondary-path modeling subsystem is significantly mitigated, leading to both faster convergence and improved noise reduction performance. A practical scheme for refreshing the entire system is also developed to enhance its robustness against even abrupt changes with the secondary path or the primary noise. The present disclosure enhances the applicability of feedback active noise control in practical applications.

9 Claims, 4 Drawing Sheets

(52) U.S. Cl.
CPC ..... *G10K 2210/3012* (2013.01); *G10K 2210/3023* (2013.01); *G10K 2210/3026* (2013.01); *G10K 2210/3035* (2013.01)

(58) Field of Classification Search
CPC ... G10K 2210/3023; G10K 2210/3026; G10K 2210/3035
USPC ..... 381/71.8
See application file for complete search history.

(56) References Cited

U.S. PATENT DOCUMENTS

| | | | | | |
|---|---|---|---|---|---|
| 5,991,418 | A * | 11/1999 | Kuo | G10K 11/17854 381/71.8 |
| 11,189,261 | B1 * | 11/2021 | Lu | G10K 11/17881 |
| 2003/0103635 | A1 | 6/2003 | Wright et al. | |
| 2004/0037430 | A1 | 2/2004 | Kim | |
| 2016/0300563 | A1 | 10/2016 | Park | |
| 2017/0125006 | A1 * | 5/2017 | Dzhigan | G10K 11/17881 |

FOREIGN PATENT DOCUMENTS

| | | | |
|---|---|---|---|
| CN | 111402853 | A | 7/2020 |
| CN | 111968613 | A | 11/2020 |
| CN | 113327570 | A | 8/2021 |

* cited by examiner

FEEDBACK ACTIVE NOISE CONTROL SYSTEM AND STRATEGY WITH ONLINE SECONDARY-PATH MODELING

TECHNICAL FIELD

The present disclosure relates to a feedback active noise control system and strategy with online secondary-path modeling, and belongs to the technical field of active noise control.

BACKGROUND

Active noise control (ANC) achieves the purpose of noise reduction by generating a secondary noise with the same amplitude and opposite phase with respect to target noise by means of the principle of destructive interference of acoustic waves, and superimposing two acoustic waves. Compared with a traditional passive noise control technology, it has the advantages of nice low-frequency noise suppression performance, small size, low cost, etc.

According to the presence or absence of a reference sensor (for obtaining a reference signal to control the generation of the secondary noise), active noise control systems can be divided into feed-forward active noise control systems and feedback active noise control systems. According to the characteristics of the frequency spectrum of the target noise, they can be further divided into broadband active noise control systems and narrowband active noise control systems (S. M. Kuo and D. R. Morgan, "Active noise control: a tutorial review," Proc. IEEE, vol. 87, no. 6, pp. 943-973, June. 1999.). In particular, the narrowband active noise control system can suppress a large amount of periodic noise or interference that are generated by rotating machines such as strand-cutters, fans, engines, etc. in practical applications.

In the case of noise reduction under high temperature or serious pollution, the feedback active noise control system does not need a reference sensor, requires less physical space and reduces the hardware cost at the same time, so it has greater practical application value.

A conventional feedback active noise control system mainly includes a secondary speaker (generating secondary noise) and an error microphone (detecting residual noise of the system). A secondary path represents a path from the secondary noise to an error sensor, and in a practical system, includes a secondary speaker, an error microphone and an acoustic space between them, and consists of a series of electronic equipment, devices and physical paths. Under practical working conditions, the secondary path often has complex time-varying characteristics, such as noise source movement, changes in the position of the active noise control device, etc., and such changes will cause changes of the actual secondary path model, which will seriously affect the stability of the system.

Therefore, it is necessary for people to study the corresponding secondary path modeling strategy to estimate the actual secondary path model so as to improve the stability of the system. In general, the secondary path modeling strategy can be divided into two types: offline secondary-path modeling and online secondary-path modeling. Compared with the traditional offline secondary-path modeling strategy, the online secondary-path modeling strategy can estimate the time-varying secondary path in real time, and has the characteristics of being suitable for complex application occasions.

In recent years, some online secondary-path modeling methods based on the auxiliary white Gaussian noise amplitude adjustment strategy are applied to the feedback active noise control system.

Scholars Xiao, et. al. proposed a feedback active noise control system based on an adaptive band trap, which directly uses the function related to residual noise to adjust the amplitude of auxiliary noise. However, the contribution of the auxiliary noise introduced in the scheme to the residual noise is large, which would restrict the noise suppression performance of the system, and the controller and the online secondary-path modeling module of the system are coupled, i.e., the residual noise is used for updating the controller and controlling the desired input of the online secondary-path modeling module respectively, resulting in that the broadband component within the residual noise restricts the update speed of the controller, and the narrowband component within the residual noise restricts the convergence rate of online secondary-path modeling, which ultimately affects the dynamic performance of the overall system. (X. Tan, Y. Ma, Y. Xiao, L. Ma, and K. Khorasani, "A new feedback narrowband active noise control system with online secondary-path modeling based on adaptive notch filtering," Proc. of ICAMechS, pp. 78-82, December. 2020.).

The scholar Akhtar proposed a feedback active noise control system. The scheme adopts a delay filter. The delay filter is applied to the online secondary-path modeling module to monitor the convergence state of the online secondary-path modeling. At the same time, the variable step size algorithm was used for updating the coefficient of the secondary path estimation model after the delay. The system can reduce the contribution of the auxiliary noise to the residual noise. However, it is difficult for the system to be applied to the scene when the secondary path or the target noise suddenly changes, and the system also has the disadvantages of large number of user parameters, complex setting and large computational cost, which greatly increases the operation burden of the system and is not conducive to practical application. In addition, the independence between the controller and the online secondary-path modeling module of the system is poor, which still restricts the dynamic performance of the whole system. (M. T. Akhtar, "Narrowband feedback active noise control systems with secondary path modeling using gain-controlled additive random noise," Digital Signal Processing, vol. 111, 2021, Art. No. 102976.).

In conclusion, there are still many problems in the above conventional feedback active noise control system with online secondary-path modeling.

(1) It is difficult to deal with the scene when a large sudden change occurs to the secondary path.

(2) The contribution of the injected auxiliary noise to the residual noise is large.

(3) System user parameters are great in number and complex in setting, which restricts its practical application.

(4) The independence between the controller and the online secondary-path modeling module is poor, which seriously affects the overall performance of the system.

In order to solve the above problems, it is necessary to provide a more effective and practical feedback active noise control system with online secondary-path modeling.

SUMMARY

In order to solve the current problems, that is, a current feedback active noise control system with online secondary-path modeling has the problems that the contribution of the injected auxiliary noise to the residual noise is large and then the noise reduction performance of the system is restricted, the independence between the controller and the online secondary-path modeling module is poor, which seriously affects the overall performance of the system, and the capability of the system to deal with a large sudden change occurring to a secondary path or target noise is poor, the present disclosure provides a feedback active noise control system and strategy with online secondary-path modeling.

A first objective of the present disclosure is to provide a feedback active noise control system with online secondary-path modeling. The active noise control system includes a reference signal synthesis subsystem (1), a secondary sound source synthesis subsystem (2), a linear prediction subsystem (3) and an online secondary-path modeling subsystem (4), the reference signal synthesis subsystem (1) being separately connected to the secondary sound source synthesis subsystem (2) and the linear prediction subsystem (3); the secondary sound source synthesis subsystem (2) being separately connected to the reference signal synthesis subsystem (1) and the online secondary-path modeling subsystem (4); the linear prediction subsystem (3) being separately connected to the reference signal synthesis subsystem (1), the secondary sound source synthesis subsystem (2) and the online secondary-path modeling subsystem (4); and the online secondary-path modeling subsystem (4) being separately connected to the secondary sound source synthesis subsystem (2) and the linear prediction subsystem (3);

the reference signal synthesis subsystem (1) being used for synthesizing a reference signal; the secondary sound source synthesis subsystem (2) being used for synthesizing a secondary sound source; the linear prediction subsystem (3) being used for separating a narrowband component and a broadband component from residual noise; the online secondary-path modeling subsystem (4) being used for estimating a time-varying secondary path estimation model on line in real time;

the narrowband component separated from the residual noise by the linear prediction subsystem (3) being used for adjusting the amplitude of auxiliary white Gaussian noise, which can reduce the contribution of injected auxiliary noise to the residual noise, and improve the noise suppression performance of the system; and the narrowband component and the broadband component separated from the residual noise by the linear prediction subsystem (3) being respectively used as a desired input of the online secondary-path modeling subsystem (4) and an error output of the secondary sound source synthesis subsystem (2) so as to improve the independence between a controller and an online secondary-path modeling module, improve the accuracy and speed of online secondary-path modeling, and improve the dynamic performance of the system at the same time.

The feedback active noise control system monitors a possible sudden change of a secondary path or target noise by calculating in real time the energy change of the residual noise after smoothing filtering, and re-initializes the coefficient of the linear prediction subsystem (3), the coefficient of the secondary path estimation model, the coefficient of the secondary sound source synthesis subsystem (2) and the scaling factor of the online secondary-path modeling subsystem (4). This strategy can improve the capability of the system to deal with the large sudden change of the secondary path or target noise, and improve its robust performance.

The energy of the residual noise after smoothing filtering is:

$$P_e(n)=\lambda_m P_e(n-1)+(1-\lambda_m)e^2(n)$$

where n is time instant time, $n\geq 0$, and $\lambda_m \in (0,1)$ is a forgetting factor of smoothing filtering.

At time instant $n'T_p$, the following is obtained by successively performing time averaging and smoothing filtering on the energy $P_e(n)$ of the residual noise after smoothing filtering:

$$P_{e,T_p}(m')=\lambda_m P_{e,T_p}(n'''1)+(1-\lambda_m)\Sigma_{k=0}^{T_p-1}P_e(n-k)$$

where n' is a positive integer greater than 1 when n is evenly divided by $T_p$, and $T_p$ is the length of a time average window.

When $P_{e,T_p}(n')\geq\alpha P_{e,T_p}(n-1)$ is satisfied at time instant n, the system performs re-initialization at time instant n+1, where $\alpha\in(1,2)$ is a threshold parameter.

Optionally, the linear prediction subsystem (3) includes a D-order delay operator (31) and a linear prediction filter (32), the D-order delay operator (31) and the linear prediction filter (32) are connected in series, the coefficient and the length of the linear prediction filter (32) are respectively $\{h_j(n)\}_{j=0}^{L-1}$ and L, the coefficient is updated using a least mean square algorithm, and the update formula is:

$$h_j(n+1)=h_j(n)+\mu_h e_{LP}(n)e(n-D-j)$$

where, $\mu_h$ is the update step size of the linear prediction filter and takes a positive value; $e_{LP}(n)$ is the broadband component separated by the linear prediction subsystem (3), and e(n) is the residual noise.

Optionally, the broadband component separated from the residual noise is:

$$e_{LP}(n) = e(n) - y_{LP}(n)$$

$$y_{LP}(n) = \sum_{j=0}^{L-1} h_j(n)e(n-D-j)$$

where $y_{LP}(n)$ is the narrowband component separated from the residual noise.

Optionally, the online secondary-path modeling subsystem (4) includes an online secondary-path modeling module (41) and an auxiliary noise adjustment module (42).

The online secondary-path modeling module (41) includes a secondary path estimation model $\hat{S}_n(z)$. The online secondary-path modeling module (41) takes the broadband component as a desired input, takes colored noise v(n) generated by white Gaussian white noise after passing through the auxiliary noise adjustment module (42) as a reference input, and uses a least mean square algorithm to estimate and update the time-varying secondary path estimation model on line in real time.

The coefficient and length of the secondary path estimation model $\hat{S}_n(z)$ of the online secondary-path modeling module (41) are respectively $\{\hat{s}_m(n)\}_{m=0}^{\hat{M}<1}$ and $\hat{M}$, and a coefficient update formula is:

$$\hat{s}_m(n-1)=\hat{s}_m(n)+\mu_s e_s(n)v(n-m)$$

$$e_s(n)=e_{LP}(n)-y_s(n)$$

where $\mu_s$ is the update step size of the secondary path estimation model and takes a positive value; and $y_s(n)$ is an output of the secondary path estimation model of the online secondary-path modeling module (41).

The colored noise v(n) is:

$$v(n)=v_0(n)G_s(n)$$

$$G_s(n)=\lambda G_s(n-1)+(1-\lambda)y_{LP}^2(n-1)$$

where $G_s(n)$ is a scaling factor of the auxiliary noise adjustment module (42), and a forgetting factor $\lambda\in(0,1)$ of the auxiliary noise adjustment module usually takes a value close to 1; and $v_0(n)$ is additive white Gaussian noise with a mean value of zero and a variance of $\sigma_0^2$.

Optionally, the reference signal synthesis subsystem (1) includes a secondary path estimation model (11) and a first-order delay operator (12), the secondary path estimation model (11) being provided by the online secondary-path modeling module (41).

The reference signal is:

$$x(n)=e(n-1)+\hat{y}_0(n-1)$$

where e(n) is the residual noise; e(n−1) is an output of e(n) via the first-order delay operator (12); $\hat{y}_0(n)$ is an output of $y_0(n)$ via the secondary path estimation model (11); and $\hat{y}_0(n-1)$ is an output of $\hat{y}_0(n)$ via the first-order delay operator (12).

Optionally, the secondary sound source synthesis subsystem (2) includes a controller (21) and a filtering-X least mean square algorithm module (22).

The filtering-X least mean square algorithm module (22) takes the narrowband component $y_{LP}(n)$ separated from the residual noise as an error output to be used for updating the coefficient of the controller (21).

Optionally, the controller (21) employs a linear filter, the coefficient and the length of the linear filter being respectively $\{w_i(n)\}_{i=0}^{M_w-1}$ and $M_w$.

The coefficient update formula of the controller (21) is:

$$w_i(n+1)=w_i(n)+\mu_w y_{LP}(n)\hat{x}(n-i)$$

where $\mu_s$ is the update step size of the controller and takes a positive value; $y_{LP}(n)$ is the narrowband component separated by the linear prediction subsystem (3); and $\hat{x}(n)$ is an output of a reference signal x(n) via a secondary path estimation model of the filtering-X least mean square algorithm module (22).

Optionally, a secondary sound source is:

$$y(n)=y_0(n)-v(n)$$

where $y_0(n)$ is an output of the controller (21).

A second objective of the present disclosure is to provide an active noise control strategy, the strategy being implemented on the basis of the above feedback active noise control system with online secondary-path modeling, and the strategy includes:

Step 1: Setting System Parameters setting the length and the update step size of the controller (21), the length and the update step size of the linear prediction filter (32), and the length and the update step size of the secondary path estimation model $\hat{S}_n(z)$; setting the order number D of a delay operator; setting a forgetting factor of the auxiliary noise adjustment module (42); setting a forgetting factor, a threshold parameter and the length of a time average window required for re-initialization of the system; setting initial values of the coefficients of the controller (21) and the secondary path estimation model $\hat{S}_n(z)$, the coefficient of the linear prediction filter (32), and the scaling factor of the auxiliary noise adjustment module (42) all to be zero;

Step 2: Synthesizing the Reference Signal adding residual noise e(n) obtained by an error microphone with an output $\hat{y}_0(n)$ of an output $y_0(n)$ of the controller (21) via the secondary path estimation model (11), and obtaining the reference signal x(n) after an obtained signal is subjected to the first-order delay operator (12);

$$x(n)=e(n-1)+\hat{y}_0(n-1)$$

i.e., summing the residual noise at time instant n−1 and an output signal of the secondary path estimation model (11) to obtain the reference signal at time instant n by synthesis;

step 3: at time instant n, firstly, obtaining $y_0(n)$, by the reference signal x(n), via the controller (21); then, obtaining auxiliary noise v(n) by the auxiliary noise adjustment module (42), and then obtaining a secondary sound source y(n) by synthesis; and finally, separating the residual noise e(n) into a narrowband component $y_{LP}(n)$ and a broadband component $e_{LP}(n)$ by the linear prediction subsystem (3);

Step 4: Updating the Control System calculating and updating the coefficient of the controller (21) at time instant n+1 according to the reference signal and the narrowband component $y_{LP}(n)$;

calculating and updating the coefficient of the linear prediction filter (32) at time instant n+1 according to the residual noise e(n) and the narrowband component $y_{LP}(n)$;

calculating and updating the coefficient of the secondary path estimation model $\hat{S}_n(z)$ at time instant n+1 according to the auxiliary noise v(n) and the broadband component $e_{LP}(n)$; and updating a scaling factor of the auxiliary noise adjustment module (42) at time instant n+1 according to the narrowband component $Y_{LT}(n)$;

Step 5: calculating the energy change of the residual noise after smoothing filtering in real time, i.e., if $P_{e,T_p}(n')\geq\alpha P_{e,T_p}(n'-1)$ is satisfied, re-initializing the coefficient of the linear prediction filter (32), the coefficient of the secondary path estimation model $\hat{S}_n(z)$, the adjustment gain of the auxiliary noise adjustment module (42) and the coefficient of the controller (21) at time instant n+1, and then proceeding to step 6; if $P_{e,T_p}(n')\geq\alpha P_{e,T_p}(n'-1)$ is not satisfied, then directly proceeding to step 6; and step 6: returning to step 2, and repeating steps 2-5 described above until the system converges and reaches a steady state.

The present disclosure has the beneficial effects as follows.

1. By separating the narrowband component and the broadband component from the residual noise, the present disclosure uses the narrowband component of the residual noise to adjust the amplitude of the auxiliary white Gaussian noise, significantly reducing the contribution of injected auxiliary noise to the residual noise, and improving the noise reduction performance of the system.

2. The present disclosures uses the broadband component separated from the residual noise to update the online secondary-path modeling module and uses the narrowband component separated from the residual noise to update the controller, improving the independence between the controller and the online secondary-path modeling module, improving the accuracy and speed of online secondary-path modeling, and improving the dynamic performance of the system at the same time.

3. By calculating the energy change of the residual noise after smoothing filtering in real time, the present disclosure monitors the possible large sudden change of the secondary path or target noise, and re-initializes the system, so as to improve the capability of the system to deal with the large sudden change of the secondary path or target noise, and improve the robustness of the system, which is applicable to occasions of complex noise reduction.

In addition, the present disclosure does not require a reference sensor, reduces the requirement for the physical space and lowers the system hardware cost, furthermore, it not only enjoys nice performance of tracking time-varying secondary path, but also can theoretically realize that the residual noise tends to the environmental level after the system reaches its steady state, which is beneficial for practical applications.

BRIEF DESCRIPTION OF FIGURES

To describe the technical solutions in the examples of the present disclosure more clearly, the following briefly introduces the accompanying drawings required for describing the examples. Apparently, the accompanying drawings in the following description show merely some examples of the present disclosure, and those of ordinary skill in the art may still derive other accompanying drawings from these accompanying drawings without creative efforts.

DETAILED DESCRIPTION

To make the objectives, technical solutions and advantages of the present disclosure more comprehensible, detailed description is made to specific embodiments of the present disclosure below with reference to the accompanying drawings.

EXAMPLE 1

Figure 1:
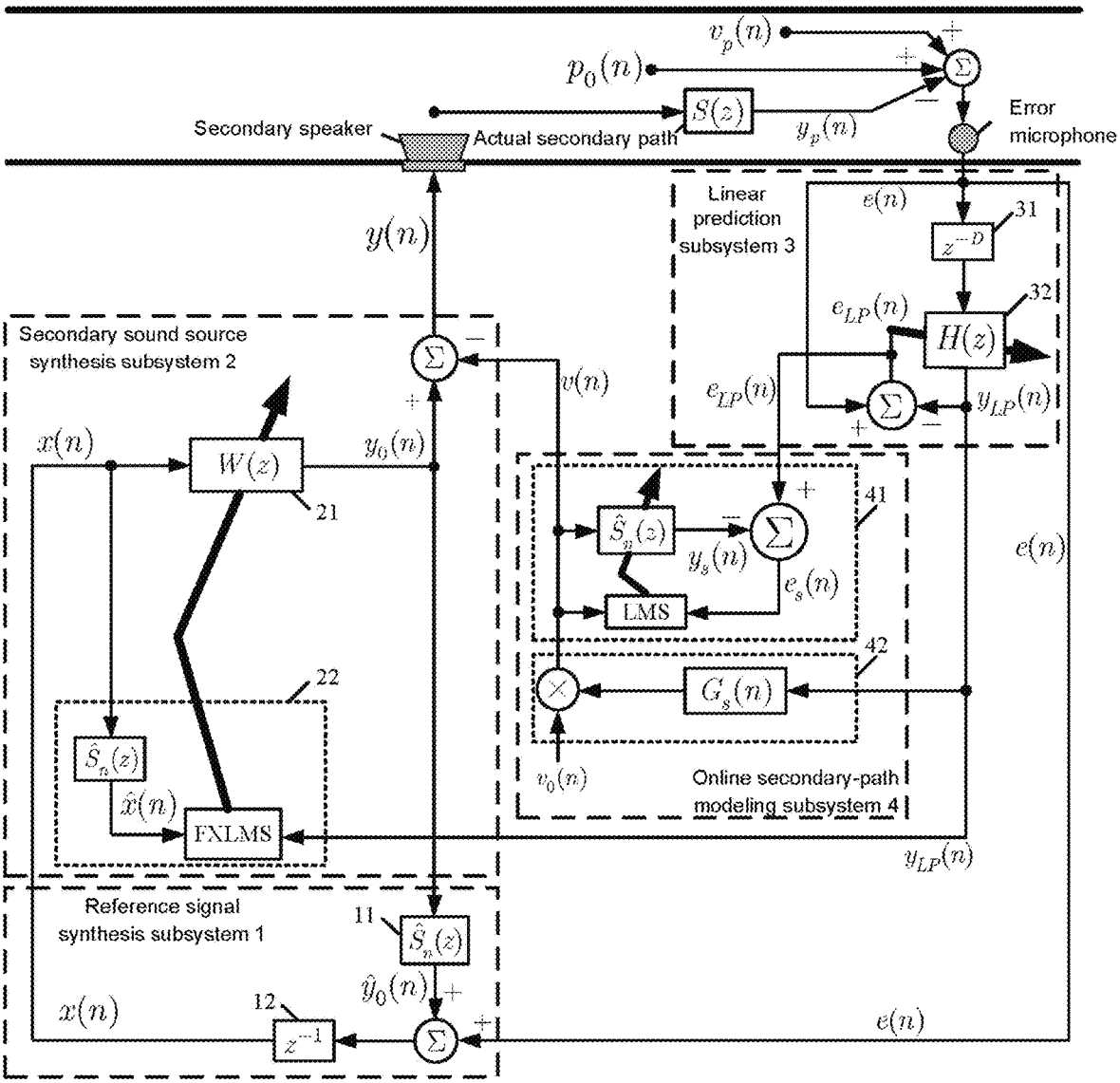
FIG. 1 is a schematic diagram of a feedback active noise control system with online secondary-path modeling of Example 1.

This example provides a feedback active noise control system with online secondary-path modeling. With reference to FIG. 1, the active noise control system includes a reference signal synthesis subsystem (1), a secondary sound source synthesis subsystem (2), a linear prediction subsystem (3) and an online secondary-path modeling subsystem (4).

The reference signal synthesis subsystem (1) synthesizes a reference signal by superposition of residual noise at the previous moment and a secondary sound source. The secondary sound source synthesis subsystem (2) uses a linear filter as a controller, and the output of the controller is added to the output of an auxiliary noise adjustment module (42) to synthesize the secondary sound source. The linear prediction subsystem (3) is composed of a D-order delay operator (31) and a linear prediction filter (32) in a serial connection manner, so as to separate a narrowband component and a broadband component from the residual noise. With the operation of the feedback active noise control system, the online secondary-path modeling subsystem (4) is used for estimating the time-varying secondary path model on line in real time to improve the stability of the system.

The target noise is:

$$p(n) = p_0(n) + v_p(n) = \sum_{i=1}^{q} [A_i \cos(\omega_{p,i} n + \theta_i)] + v_p(n)$$

where $p_0(n)$ is the narrowband noise component in the target noise; q is the number of narrowband components in the target noise, and $\{A_i\}_{i=1}^{q}$ is the amplitude of the narrowband component; $\omega_{p,i}$ is the frequency of an $i^{th}$ narrowband component in the target noise; $\theta_i$ is an initial phase of the $i^{th}$ narrowband component; $v_p(n)$ is additive white Gaussian noise with a mean value of zero and a variance of $\sigma_p^2$; and n is time instant time, $n \geq 0$.

An actual secondary path S(z) represents an acoustic spatial model from a secondary speaker to an error microphone, which may be represented by using a finite impulse response filter or an infinite impulse response filter.

The difference between the target noise p(n) and a signal $y_p(n)$ of a secondary sound source y(n) after passing through the actual secondary path S(z) is the residual noise, i.e., $e(n)=p(n)-y_p(n)$.

The reference signal synthesis subsystem (1) includes a secondary path estimation model and a first-order delay operator. The residual noise e(n) collected by an error microphone and the output $\hat{y}_p(n)$ of the output $y_0(n)$ of the controller via the secondary path estimation model (11) are added, and an obtained signal can be synthesized into a reference signal after passing through the first-order delay operator (12), i.e., $$x(n)=e(n-1)+\hat{y}_0(n-1)$$

where the secondary path estimation model (11) is provided by an online secondary-path modeling module (41).

The secondary sound source synthesis subsystem (2) includes a controller (21), a filtering-X least mean square algorithm module (22) and a linear prediction compensation model (23) with a D-order delay. The controller (21) employs a linear filter, and its coefficient and length are respectively $\{w_i(n)\}_{i=0}^{M_w-1}$ and $M_w$. The filtering-X least mean square algorithm module (22) is used for updating the coefficient of the controller (21), i.e., $$w_i(n+1)=w_i(n)+\mu_w y_{LP}(n)\hat{x}(n-i)$$

where $\mu_w$ is the update step size of the controller and takes a positive value; and $y_{LP}(n)$ is the narrowband component separated by the linear prediction subsystem (3). A signal $\hat{x}(n)$ is obtained from the reference signal x(n) via a secondary path estimation model $\hat{S}_n(z)$. The output of the controller (21) and the output of the auxiliary noise adjustment module (42) in the online secondary-path modeling subsystem (4) are added, and synthesized to obtain a secondary sound source, i.e., $y(n)=y_0(n)$—v(n).

The linear prediction subsystem (3) is composed of aD-order delay operator (31) and a linear prediction filter (32) in a serial connection manner. The linear prediction filter (32) is represented by H(z), its coefficient and the length are respectively $\{h_j(n)\}_{j=0}^{L-1}$ and L, the coefficient is updated with a least mean square algorithm, i.e., $$h_j(n+1)=h_j(n)+\mu_h e_{LP}(n)e(n-D-j)$$

in the formula, $\mu_h$ is the update step size of the linear prediction filter and takes a positive value; and $e_{LP}(n)$ is the broadband component separated by the linear prediction subsystem (3), i.e., the difference between the residual noise and the output of the linear prediction filter (32): $e_{LP}(n)=e(n)-y_{LP}(n)$, where $$y_{LP}(n) = \sum_{j=0}^{L-1} h_j(n)e(n-D-j).$$

The linear prediction subsystem (3) is used for separating the narrowband component $y_{LP}(n)$ and the broadband component $e_{LP}(n)$ from the residual noise.

The online secondary-path modeling subsystem (4) includes an online secondary-path modeling module (41) and an auxiliary noise adjustment module (42). The online secondary-path modeling module (41) takes the broadband component separated by the linear prediction subsystem (3) as a desired input $e_{LP}(n)$, takes colored noise v(n) generated by the auxiliary white Gaussian noise $v_0(n)$ after passing through the auxiliary noise adjustment module (42) as a reference input, and uses a least mean square algorithm to estimate a time-varying secondary path model on line in real time. The coefficient and the length of a corresponding secondary path estimation model are respectively $\{\hat{s}_m(n)\}_{m=0}^{\hat{M}-1}$ and $\hat{M}$, and the coefficient update formula is:

$$\hat{S}_m(n+1)=\hat{S}_m(n)+\mu_s e_s(nv(n=m)$$

$$e_s(n)=e_{LP}(n-y_s(n)$$

in the formula, $\mu_s$ is the update step size of the secondary path estimation model and takes a positive value. The stability of the system is improved. The auxiliary noise adjustment module (42) takes the narrowband component $y_{LP}(n)$ separated by the linear prediction subsystem (3) as an input, and the scaling factor is expressed as:

$$G_s(n)=\lambda G_s(n-1)+(1-\lambda)y_{LP}^2(n-1)$$

in the formula, a forgetting factor $\lambda\in(0,1)$ of the auxiliary noise adjustment module usually takes a value close to 1. Then, the colored noise generated by the auxiliary white Gaussian noise $v_0(n)$ after passing through the auxiliary noise adjustment module (42) is $v(n)=v_0(n)G_s(n)$, where $v_0(n)$ is additive white Gaussian noise with a mean value of zero and a variance of $\sigma_0^2$.

The system monitors a possible sudden change of the secondary path or target noise by calculating the energy change of the residual noise after smoothing filtering in real time, and re-initializes the coefficient of the linear prediction filter (32), the coefficient of the secondary path estimation model $\hat{S}_n(z)$, the coefficient of the controller (21) and the scaling factor of the auxiliary noise adjustment module (42).

The energy of the residual noise after smoothing filtering is:

$$P_e(n)=\lambda_m P_e(n-1)+(1-\lambda_m)e^2(n)$$

where $\lambda_m \in(0,1)$ is a forgetting factor of smoothing filtering.

At time instant $n'T_p$, the following is obtained by successively performing time averaging and smoothing filtering on the energy $P_e(n)$ of the residual noise after smoothing filtering:

$$P_{e,T_p}(n')=\lambda_m P_{e,T_p}(n'-1)+(1-\lambda_m)\Sigma_{k=0}^{T_p-1}P_e(n-k)$$

where n' is a positive integer greater than 1 when n is evenly divided by $T_p$, and $T_p$ is the length of a time average window.

When $P_{e,T_p}(n')\geq\alpha P_{e,T_p}(n'-1)$ is satisfied at time instant n, the system performs re-initialization at time instant n+1, where $\alpha\in(1, 2)$ is a threshold parameter.

EXAMPLE 2

This Example provides a feedback active noise control strategy with online secondary-path modeling, and the strategy is achieved based on the above active noise control with online secondary-path modeling, and includes Step 1: Setting System Parameters setting the length and the update step size of the controller (21), the length and the update step size of the linear prediction filter (32), and the length and the update step size of the secondary path estimation model $\hat{S}_n(z)$; setting the order number D of a delay operator; setting a forgetting factor of the auxiliary noise adjustment module (42); setting a forgetting factor, a threshold parameter and the length of a time average window required for re-initialization of the system; setting initial values of the coefficients of the controller (21) and the secondary path estimation model $\hat{S}_n(z)$, and the coefficient of the linear prediction filter (32) all to be zero;

Step 2: Synthesizing the Reference Signal adding residual noise e(n) obtained by an error microphone with an output $\hat{y}_0(n)$ of an output $y_0(n)$ of the controller (21) via the secondary path estimation model (11), and obtaining the reference signal x(n) after an obtained signal is subjected to the first-order delay operator (12), i.e. $x(n)=e(n-1)+\hat{y}_0(n-1)$, i.e., summing the residual noise at time instant n−1 and an output signal of the secondary path estimation model (11) to obtain the reference signal at time instant n by synthesis;

Step 3: at time instant n, firstly, obtaining $y_0(n)$, by the reference signal x(n), via the controller (21); then, obtaining auxiliary noise v(n) by the auxiliary noise adjustment module (42), and then obtaining a secondary sound source y(n) by synthesis; and finally, separating the residual noise e(n) into a narrowband component $y_{LP}(n)$ and a broadband component $e_{LP}(n)$ by the linear prediction subsystem (3);

Step 4: Updating the Control System calculating and updating the coefficient of the controller (21) at time instant n+1 according to the reference signal and the narrowband component $y_{LP}(n)$;

calculating and updating the coefficient of the linear prediction filter (32) at time instant n+1 according to the residual noise e(n) and the narrowband component $y_{LP}(n)$;

calculating and updating the coefficient of the secondary path estimation model $\hat{S}_n(z)$ at time instant n+1 according to the auxiliary noise v(n) and the broadband component $e_{LP}(n)$; and updating a scaling factor of the auxiliary noise adjustment module (42) at time instant n+1 according to the narrowband component $y_{LP}(n)$;

step 5: calculating the energy change of the residual noise after smoothing filtering in real time, i.e., if $P_{e,T_p}(n')\geq\alpha P_{e,T_p}(n'-1)$ is satisfied, re-initializing the coefficient of the linear prediction filter (32), the coefficient of the secondary path estimation model $\hat{S}_n(z)$, the scaling factor of the auxiliary noise adjustment module (42) and the coefficient of the controller (21) at time instant n+1, and then proceeding to step 6; if $P_{e,T_p}(n')\div\alpha P_{e,T_p}(n'-1)$ is not achieved, then directly proceeding to step 6.

step 6: returning to step 2, and repeating the steps 2-5 described above until the system converges and reaches a steady state to achieve active noise control.

EXAMPLE 3

Verification in Case of Simulated Noise and Simulated Secondary Path

The target noise is composed of five frequency components and additive white Gaussian noise. The normalized angular frequencies of the five frequency components are respectively 0.10π, 0.15π, 0.20π, 0.25π and 0.30π. The amplitudes of the corresponding frequency components are respectively 1.41, 1.00, 0.50, 0.25 and 0.10. The additive white Gaussian noise has a mean value of zero and a variance of 0.10.

In order to simulate the large sudden change of a secondary path, a linear FIR model is adopted for an actual secondary path S(z), its cut-off frequency is 0.5 π, and the model lengths of the first half and the second half are 51 and 31, respectively. The length of a secondary path estimation model is 53, and the update step size of the corresponding coefficient is 0.0005. Auxiliary white Gaussian noise $v_0(n)$ has a mean value of zero and a variance of 0.25. The forgetting factor of an auxiliary noise adjustment module (42) is 0.9995. A delay length of the D-order delay operator (31) is 55; the length of the linear prediction filter (32) is 128, and the update step size of the coefficient is 0.001. The controller (21) adopts a linear filter, its length is 128, and the update step size of the coefficient is 0.000075. $\lambda_m$, α and $T_p$ are 0.98, 1.1 and 20, respectively. The number of independent operations is 100. The length of simulation data is 60000.

Figure 2A:
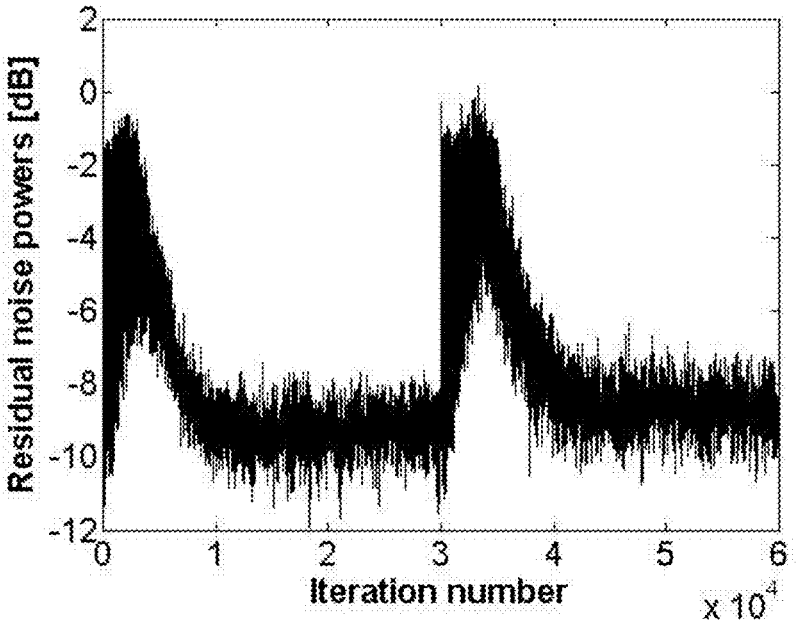
FIG. 2A is a graph showing the change of residual noise powers of Example 3.
Figure 2B:
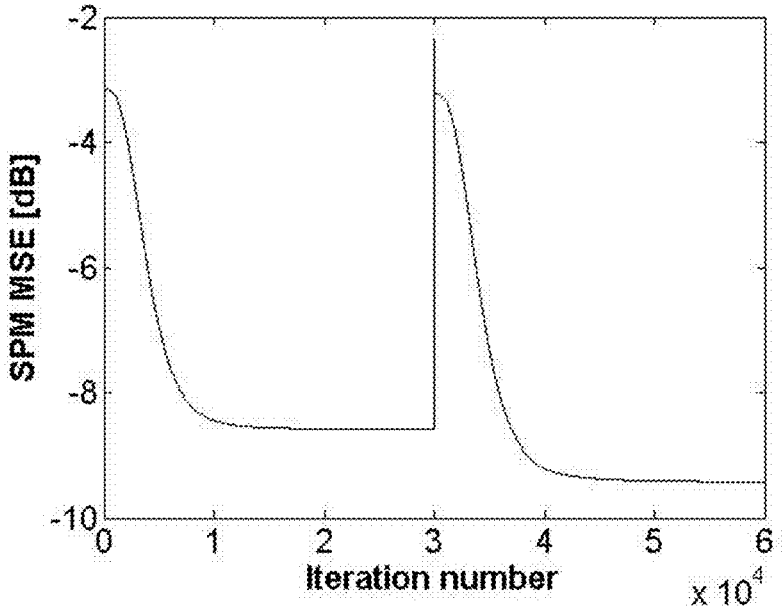
FIG. 2B is a graph showing the change of mean square error (MSE) of secondary path modeling (SPM) of Example 3.
Figure 2C:
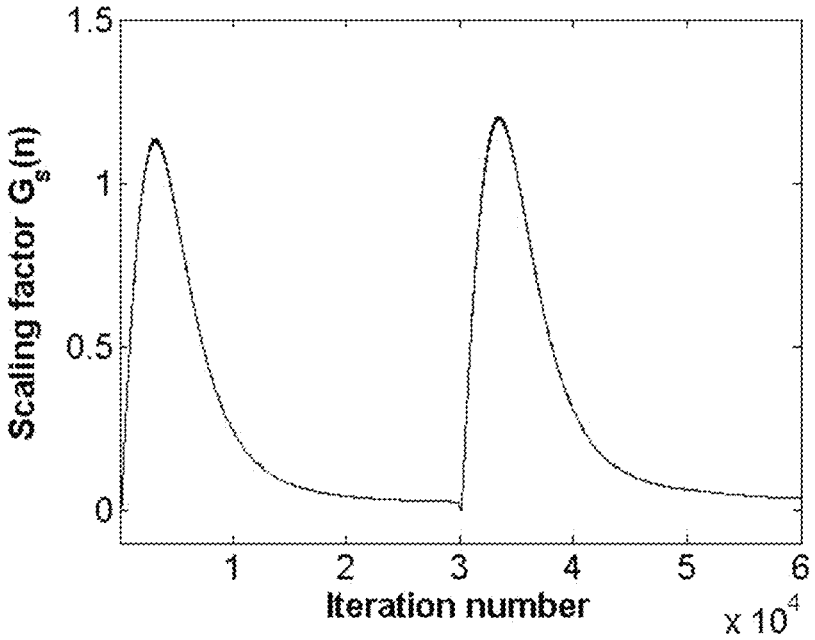
FIG. 2C is a graph showing the change of an auxiliary noise scaling factor of Example 3.

FIG. 2A is a plot showing the change of target noise and residual noise in the case of simulated noise and a simulated secondary path of Example 3. When the system reaches a steady state, the noise reduction of the first half and the second half are 10.84 dB and 10.46 dB, respectively, and the corresponding residual noise energy of the system are about 0.15 and 0.16, respectively, which are close to the variance of the additive white Gaussian noise in the target noise, i.e. approaching to the ambient noise level, with good target noise suppression performance. FIG. 2B is a plot showing the change of mean square error of secondary-path modeling in this case, and FIG. 2C is a plot showing the change of an auxiliary noise scaling factor in this case, which together show that the system of the present disclosure can not only effectively track the large sudden change of the secondary path, but also has high online secondary-path modeling accuracy.

EXAMPLE 4

Verification in Case of Actual Noise and Actual Secondary Path

Actual noise is from a discharge port of a large cutting machine under working conditions. In order to simulate the larger sudden changes of the target noise, the target noise is divided into the first half and the second half, the first half corresponding to a rotation speed at 1,400 rpm and the second half corresponding to a rotation speed at 1,600 rpm. The actual secondary path is an IIR model that is widely adopted by peers (S. M. Kuo and D. R. Morgan, Active Noise Control Systems-Algorithms and DSP Implementation, New York: Wiley, 1996.). The length of a secondary path estimation model $\hat{S}(z)$ is 32 and a corresponding update step size of the coefficient is 0.4. Auxiliary white Gaussian noise $v_0(n)$ has a mean value of zero and a variance of 1.0. The forgetting factor of an auxiliary noise adjustment module (42) is 0.9995. A delay length of a D-order delay operator (31) is 61. The length of the linear prediction filter (32) is 192, and the update step size of the coefficients is 0.5. A controller (21) employs a linear filter with length is 192, and the update step size of the coefficient is 0.040. $\lambda_m$, α and $T_p$ are 0.98, 1.8 and 20, respectively. The number of independent operations is 100. The length of simulation data is 120,000.

Figure 3A:
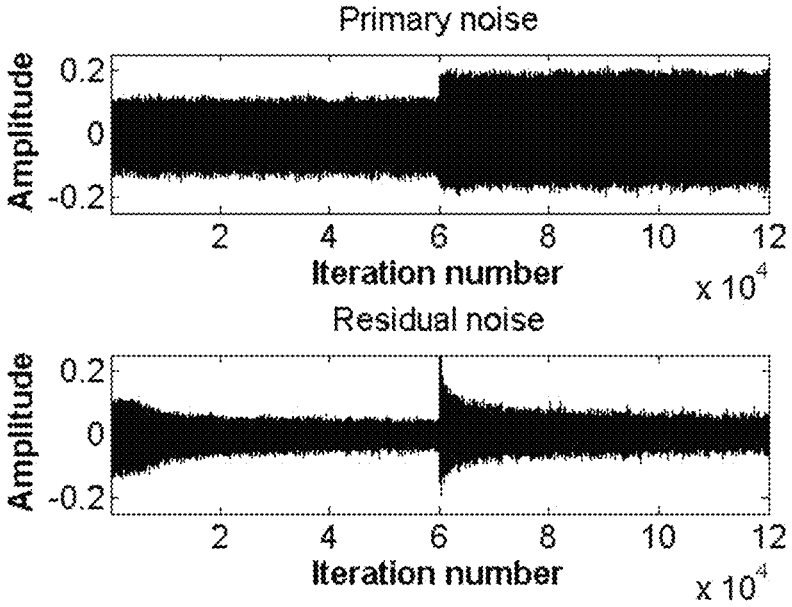
FIG. 3A is a graph showing the change of target noise and residual noise of Example 4.
Figure 3B:
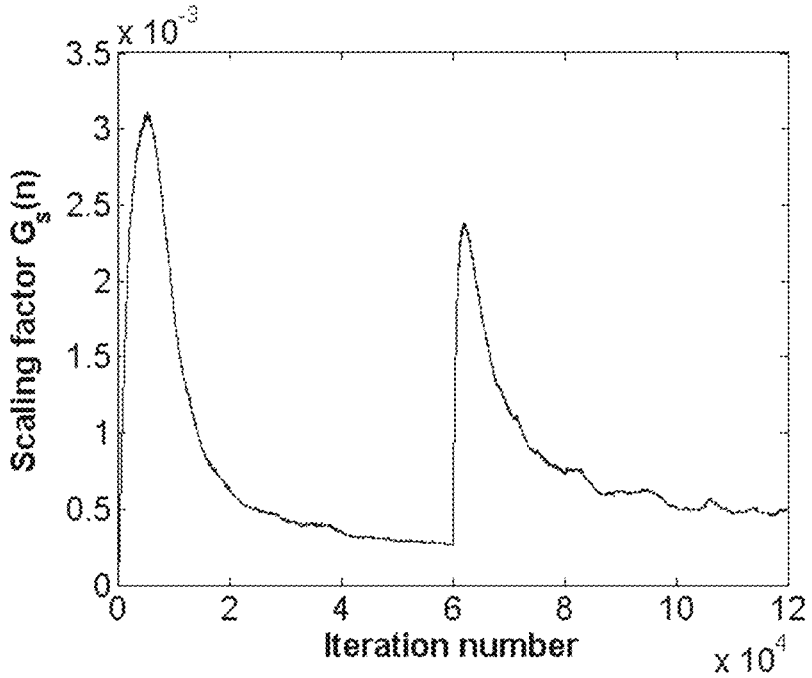
FIG. 3B is a graph showing the change of an auxiliary noise scaling factor of Example 4.

FIG. 3A is a plot showing the change of target noise and residual noise in the case of actual target noise and an actual secondary path in Example 4. FIG. 3B is a plot showing the change of an auxiliary noise scaling factor in this case. When the system reaches its steady state, the noise reduction of the first half and the second half of the system are 10.55 dB and 12.08 dB, respectively, showing that the system of the present disclosure can not only effectively estimate the actual secondary path in an IIR type, but also has nice performance of suppressing the target noise with large sudden change.

Some of the steps in the examples of the present disclosure may be implemented using software, and the corresponding software program may be stored in a readable storage medium, such as an optical disk or a hard disk.

The above description is only preferred examples of the present disclosure, and is not intended to limit the present disclosure. Any modification, equivalent replacement, or improvement made within the spirit and principle of the present disclosure shall fall within the scope of protection of the present disclosure.

What is claimed is:

1. A feedback active noise control system with online secondary-path modeling, the feedback active noise control system comprising: a reference signal synthesis subsystem (1), a secondary sound source synthesis subsystem (2), a linear prediction subsystem (3) and an online secondary-path modeling subsystem (4);

wherein the reference signal synthesis subsystem (1) is separately connected to the secondary sound source synthesis subsystem (2) and the linear prediction subsystem (3); the secondary sound source synthesis subsystem (2) is separately connected to the reference signal synthesis subsystem (1) and the online secondary-path modeling subsystem (4); the linear prediction subsystem (3) is separately connected to the reference signal synthesis subsystem (1), the secondary sound source synthesis subsystem (2) and the online secondary-path modeling subsystem (4); and the online secondary-path modeling subsystem (4) is separately connected to the secondary sound source synthesis subsystem (2) and the linear prediction subsystem (3);

the reference signal synthesis subsystem (1) is used for synthesizing a reference signal; the secondary sound source synthesis subsystem (2) is used for synthesizing a secondary sound source; the linear prediction subsystem (3) is used for separating a narrowband component and a broadband component from residual noise; the online secondary-path modeling subsystem (4) is used for estimating a time-varying secondary path estimation model on line in real time;

the narrowband component separated from the residual noise by the linear prediction subsystem (3) is used for adjusting an amplitude of auxiliary white Gaussian noise, reducing the contribution of injected auxiliary noise to the residual noise, and improving the noise suppression performance of the system;

the broadband component and the narrowband component separated from the residual noise by the linear prediction subsystem (3) are respectively used as a desired input of the online secondary-path modeling subsystem (4) and an error signal for the secondary sound source synthesis subsystem (2) so as to improve the independence between a controller and an online secondary-path modeling module, improve the accuracy and speed of online secondary-path modeling, and improve a dynamic performance of the system at the same time;

the feedback active noise control system monitoring a possible sudden change of a secondary path or target noise by calculating in real time an energy change of the residual noise after smoothing filtering, and re-initializing a coefficient of the linear prediction subsystem (3), a coefficient of the secondary path estimation model, a coefficient of the secondary sound source synthesis subsystem (2) and a scaling factor of the online secondary-path modeling subsystem (4) so as to improve the capability of the system to deal with a large sudden change of the secondary path or target noise, and improve the robust performance of the feedback active noise control system;

the energy of the residual noise after smoothing filtering being:

$$P_e(n)=\lambda_m P_e(n-1)+(1-\lambda_m)e^2(n)$$

wherein n is time instant, n≥0, and $\lambda_m \in (0,1)$ is a forgetting factor of smoothing filtering;

at time instant $n'T_p$, the following being obtained by successively performing time averaging and smoothing filtering on the energy $P_e(n)$ of the residual noise after smoothing filtering:

$$P_{e,T_p}(n') = \lambda_m P_{e,T_p}(n'-1) + (1-\lambda_m)\sum_{k=0}^{T_p-1} P_e(n-k)$$

wherein n' is a positive integer greater than 1 when n is evenly divided by $T_p$, and $T_p$ is the length of a time average window;

when $P_{e,T_p}(n')\geq\alpha P_{e,T_p}(n'-1)$ is satisfied at time instant n, the system performing re-initialization at the moment n+1, wherein $\alpha \in (1,2)$ is a threshold parameter.

2. The system according to claim 1, wherein the linear prediction subsystem (3) comprises a D-order delay operator (31) and a linear prediction filter (32), the D-order delay operator (31) and the linear prediction filter (32) are connected in series, a coefficient and a length of the linear prediction filter (32) are respectively $\{h_j(n)\}_{j=0}^{L-1}$ and L, the coefficient is updated using a least mean square algorithm, and the update formula is:

$$h_j(n+1)=h_j(n)+\mu_h e_{LP}(n)e(n-D-j)$$

wherein $\mu_h$ is the update step size of the linear prediction filter and takes a positive value; D is a delay order number; $e_{LP}(n)$ is the broadband component separated by the linear prediction subsystem (3), and e(n) is the residual noise.

3. The system according to claim 2, wherein the broadband component separated from the residual noise is:

$$e_{LP}(n) = e(n) - y_{LP}(n)$$

$$y_{LP}(n) = \sum_{j=0}^{L-1} h_j(n)e(n-D-j)$$

wherein $y_{LP}(n)$ is the narrowband component separated from the residual noise.

4. The system according to claim 3, wherein the online secondary-path modeling subsystem (4) comprises an online secondary-path modeling module (41) and an auxiliary noise adjustment module (42);

the online secondary-path modeling module (41) comprises a secondary path estimation model $\hat{S}_n(z)$; the online secondary-path modeling module (41) takes the broadband component as a desired input, takes colored noise v(n) generated by white Gaussian noise after passing through the auxiliary noise adjustment module (42) as a reference input, and uses a least mean square algorithm to estimate and update the time-varying secondary path estimation model on line in real time;

a coefficient and length of the secondary path estimation model $\hat{S}_n(z)$ of the online secondary-path modeling module (41) are respectively $\{\hat{s}_m(n)\}_{m=0}^{\hat{M}-1}$ and $\hat{M}$, and a coefficient update formula is:

$$\hat{S}_m(n+1)=\hat{S}_m(n)+\mu_s e_s(n)v(n-m)$$

$$e_s(n)=e_{LP}(n)-y_s(n)$$

wherein $\mu_s$ is the update step size of the secondary path estimation model and takes a positive value; and $y_s(n)$ is an output of the secondary path estimation model of the online secondary-path modeling module (41);

the colored noise v(n) is:

$$v(n)=v_0(n)G_s(n)$$

$$G_s(n)=\lambda G_s(n-1)+(1-\lambda)y_{LP}^2(n-1)$$

wherein $G_s(n)$ is a scaling factor of the auxiliary noise adjustment module (42); λ is a forgetting factor of the auxiliary noise adjustment module, $\lambda\in(0,1)$; and $v_0(n)$ is additive white Gaussian noise with a mean value of zero and a variance of $\sigma_0^2$.

5. The system according to claim 4, wherein the reference signal synthesis subsystem (1) comprises a secondary path estimation model (11) and a first-order delay operator (12), the secondary path estimation model (11) being provided by the online secondary-path modeling module (41);

the reference signal is:

$$x(n)=e(n-1)+\hat{y}_0(n-1)$$

wherein e(n−1) is an output of the residual noise e(n) via the first-order delay operator (12); $\hat{y}_0(n)$ is an output of $y_0(n)$ via the secondary path estimation model (11); and $\hat{y}_0(n-1)$ is an output of $\hat{y}_0(n)$ via the first-order delay operator (12).

6. The system according to claim 5, wherein the secondary sound source synthesis subsystem (2) comprises a controller (21) and a filtering-X least mean square algorithm module (22);

the filtering-X least mean square algorithm module (22) takes the narrowband component $y_{LP}(n)$ separated from the residual noise as an error output to be used for updating the coefficient of the controller (21).

7. The system according to claim 6, wherein the controller (21) employs a linear filter, a coefficient and a length of the linear filter being respectively $\{w_i(n)\}_{i=0}^{M_w-1}$ and $M_w$;

the coefficient update formula of the controller (21) is:

$$w_i(n+1)=w_i(n)+\mu_w y_{LP}(n)\hat{x}(n-i)$$

wherein $\mu_w$ is the update step size of the controller and takes a positive value; $y_{LP}(n)$ is the narrowband component separated by the linear prediction subsystem (3); and $\hat{x}(n)$ is an output of a reference signal x(n) via a secondary path estimation model of the filtering-X least mean square algorithm module (22).

8. The system according to claim 7, wherein a secondary sound source is:

$$y(n)=y_0(n)-v(n)$$

wherein $y_0(n)$ is an output of the controller (21).

9. An active noise control method, the method being implemented on the basis of the feedback active noise control system with online secondary-path modeling according to claim 8, and the method comprises:

step 1: setting system parameters:

setting the length and the update step size of the controller (21), the length and the update step size of the linear prediction filter (32), and the length and the update step size of the secondary path estimation model $\hat{S}_n(z)$; setting the order number D of a delay operator; setting a forgetting factor of the auxiliary noise adjustment module (42); setting a forgetting factor, a threshold parameter and the length of a time average window required for re-initialization of the system; setting initial values of the coefficients of the controller (21) and the secondary path estimation model $\hat{S}_n(z)$, the coefficient of the linear prediction filter (32), and the scaling factor of the auxiliary noise adjustment module (42) all to be zero;

step 2: synthesizing the reference signal:

adding residual noise e(n) obtained by an error microphone with an output $\hat{y}_0(n)$ of an output $y_0(n)$ of the controller (21) via the secondary path estimation model (11), and obtaining the reference signal x(n) after an obtained signal is subjected to the first-order delay operator (12);

$$x(n)=e(n-1)+\hat{y}_0(n-1)$$

that is, summing the residual noise at time instant n−1 and an output signal of the secondary path estimation model (11) to obtain the reference signal at time instant n by synthesis;

step 3: at time instant n, firstly, obtaining $y_0(n)$, by the reference signal x(n), via the controller (21); then, obtaining auxiliary noise v(n) by the auxiliary noise adjustment module (42), and then obtaining a secondary sound source y(n) by synthesis; and finally, separating the residual noise e(n) into a narrowband component $y_{LP}(n)$ and a broadband component $e_{LP}(n)$ by the linear prediction subsystem (3);

step 4: updating the control system:

calculating and updating the coefficient of the controller (21) at time instant n+1 according to the reference signal and the narrowband component $y_{LP}(n)$;

calculating and updating the coefficient of the linear prediction filter (32) at time instant n+1 according to the residual noise e(n) and the narrowband component $y_{LP}(n)$;

calculating and updating the coefficient of the secondary path estimation model $\hat{S}_n(z)$ at time instant n+1 according to the auxiliary noise v(n) and the broadband component $e_{LP}(n)$; and updating a scaling factor of the auxiliary noise adjustment module (42) at time instant n+1 according to the narrowband component $y_{LP}(n)$;

step 5: calculating the energy change of the residual noise after smoothing filtering in real time, i.e., if $P_{e,T_p}(n')\geq \alpha P_{e,T_p}(n'-1)$ is satisfied, re-initializing the coefficient of the linear prediction filter (32), the coefficient of the secondary path estimation model $\hat{S}_n(z)$, the scaling factor of the auxiliary noise adjustment module (42) and the coefficient of the controller (21) at time instant n+1, and then proceeding to step 6; if $P_{e,T_p}(n')\geq\alpha_{e,T_p}(n'-1)$ is not satisfied, then directly proceeding to step 6; and step 6: returning to step 2, and repeating steps 2-5 described above until the system converges and reaches a steady state.

* * * * *